US008061419B2

(12) United States Patent
Khazanovich et al.

(10) Patent No.: US 8,061,419 B2
(45) Date of Patent: Nov. 22, 2011

(54) CASING HEAD SLIP LOCK CONNECTION FOR HIGH TEMPERATURE SERVICE

(75) Inventors: Abram Khazanovich, Edmonton (CA); Irina Khazanovich, Edmonton (CA)

(73) Assignee: Stream-Flo Industries Ltd., Edmonton (CA)

( * ) Notice: Subject to any disclaimer, the term of this patent is extended or adjusted under 35 U.S.C. 154(b) by 0 days.

(21) Appl. No.: 12/270,577

(22) Filed: Nov. 13, 2008

(65) Prior Publication Data

US 2009/0120648 A1 May 14, 2009

Related U.S. Application Data

(60) Provisional application No. 60/987,676, filed on Nov. 13, 2007.

(51) Int. Cl.
*E21B 19/00* (2006.01)

(52) U.S. Cl. ..... 166/89.3; 166/85.5

(58) Field of Classification Search ..... 166/89.3, 166/88.2, 85.5, 75.13, 88.3, 350, 368, 75.11
See application file for complete search history.

(56) References Cited

U.S. PATENT DOCUMENTS

| | | | | |
|---|---|---|---|---|
| 1,855,483 | A * | 4/1932 | Mildren | 166/88.2 |
| 2,568,581 | A * | 9/1951 | Crain | 285/123.7 |
| 3,485,051 | A * | 12/1969 | Watkins | 405/204 |
| 4,799,714 | A | 1/1989 | Collet | |
| 5,031,695 | A | 7/1991 | Cain et al. | |
| 5,135,266 | A | 8/1992 | Bridges et al. | |
| 5,158,326 | A | 10/1992 | Anderson et al. | |
| 5,183,268 | A * | 2/1993 | Wong et al. | 277/328 |
| 5,257,792 | A * | 11/1993 | Putch et al. | 277/328 |
| 5,332,043 | A | 7/1994 | Ferguson | |
| 5,899,507 | A | 5/1999 | Schroeder et al. | |
| 5,996,695 | A | 12/1999 | Koleilat et al. | |
| 6,834,718 | B2 | 12/2004 | Webster et al. | |
| 7,128,143 | B2 | 10/2006 | Van Bilderbeek | |

FOREIGN PATENT DOCUMENTS

| | | |
|---|---|---|
| CA | 2015966 | 1/1991 |

OTHER PUBLICATIONS

Stream-Flo Engineering Bulletin No. 1-20, dated Jul. 17, 2002, pp. 1-3.

* cited by examiner

*Primary Examiner* — Shane Bomar
*Assistant Examiner* — Kipp Wallace
(74) *Attorney, Agent, or Firm* — Greenlee Sullivan P.C.

(57) ABSTRACT

A wellhead connection for connecting and sealing to a casing, including an upper head housing accommodating the upper end of the casing in its central bore, a stop shoulder in the central bore to allow the upper head housing to rest on the upper end of the casing, and a seal profile section formed at the lower end of the central bore below the stop shoulder. The wellhead connection is configured such that, first connecting the slip housing and bottom ring with a bottom connector energizes slip connectors into gripping engagement with the casing and locks the slip housing and bottom ring around the casing, while thereafter connecting the upper head housing and the bottom ring with a top connector energizes the metal seal ring so as to radially compress the metal seal ring against the casing to form a metal seal.

10 Claims, 5 Drawing Sheets

CASING HEAD SLIP LOCK CONNECTION FOR HIGH TEMPERATURE SERVICE

CROSS-REFERENCE TO RELATED APPLICATIONS

This application claims priority from U.S. Provisional Patent Application No. 60/987,676 filed Nov. 13, 2007, which is incorporated by reference herein to the extent that there is no inconsistency with the present disclosure.

BACKGROUND OF THE INVENTION

This invention relates to a wellhead connection to casing. The invention also extends to a method of making the wellhead connection.

The lower part of a wellhead is called a casing head or tubing head, hereinafter termed casing head. The casing head is attached to a casing (pipe) and provides a connection to the wellhead equipment located thereabove. The connection must be able to seal well pressure and transmit mechanical loads in any direction. Common connections to a casing are either by threading or by welding. For high temperature service the common connection is welding. The problems with these methods of attaching the casing head are that they may require extensive time and labour, are often expensive, and create the possibility of installation errors. Also, experienced welders may not be available.

Another method is to attach the casing head using a means for gripping the casing pipe with mechanically activated teeth. A seal between the casing head and the casing pipe is then provided separately, usually in the form of an elastomeric seal ring (for example an O-ring) located in the casing head above a mechanical gripping mechanism. Such an assembly is well known in the industry and is described in, for example, U.S. Pat. No. 4,799,714 issued to Collet, U.S. Pat. No. 5,332,043 issued to Ferguson, and Canadian Patent 2,015,966 issued to Anderson et al. Each of these patents describes a known method for mechanically attaching the casing head to the surface casing. These patents disclose the use of conical slip segments which surround the casing pipe, each slip segment being provided with a plurality of grooves on their straight inside surface (casing pipe-contacting surface) that act as teeth that bite into the outer surface of the casing. A slip housing, or actuation sleeve, with a reverse conical mating surface to the conical surface on the outside of the slip segments, is then driven against the slip segments (or the slip segments are driven against the sleeve/housing). This forces the slip segments against the surface casing pipe causing the grooves to frictionally grip (or the teeth to bite into) the casing pipe, and thus to secure the casing pipe to the casing head. These slip segments are commonly referred to as "slips" and the system is commonly described as a slip lock casing connector, or slip connector.

The slip lock casing connector has advantages over the previously described casing connectors. These include reduced installation time compared to welding, and unlike a threaded connection, proper orientation of the head can be achieved.

While one or more elastomeric seals, such as O-ring seals are typically used to seal the central bore of the casing head to the surface casing, in high temperature and/or corrosive environments, these seals can fail. In those applications, a metal seal to the casing pipe is preferred. Several examples of metal seals in casing heads are shown in the prior art. For example, U.S. Pat. No. 5,158,326 to Anderson et al., describes a casing head system which includes a pair of metal seal rings above slip lock connectors. Both the slips and the metal seal are actuated with a dual acting hydraulic piston, which when activated in different directions, has the effect of energizing the seal rings and the slip connectors. This is a complex device, in which the slip connectors are energized opposite to the normal direction, with the casing moving upwardly against the downwardly moving slips (normally the casing pulls down against the upwardly moving slips in casing slip lock connectors). During this movement to energize the slips, there is opportunity for the casing to move downwardly, thus damaging the metal seal. Ideally, a metal seal, to remain intact, should move only radially inwardly to seal the casing, with no vertical movement.

U.S. Pat. No. 5,135,266 to Bridges et al., shows a combination slip lock connector and seal assembly for a casing head. An annular metal slip member has upper and lower conical sections which co-operate with conical sections of upper and lower wellhead housing members such that the slip member is wedged and thus moves radially inwardly as the upper and lower wellhead members are bolted together. Elastomeric seals are provided at the upper and lower ends of the annular slip member. As noted in the patent, care must be taken not to apply too much radial force on installation, since this can cause the slip member to crush the casing. As with the Anderson et al. patent, the seals and the slips in the Bridges et al. patent are simultaneously energized, making it difficult to prevent vertical movement at the seals.

A wellhead connection is needed which takes advantage of slip lock connectors, while also providing for a reliable metal seal to the casing such that the seal can be energized without vertical movement being imparted from the slip energizing step.

SUMMARY OF THE INVENTION

The present invention provides a wellhead connection and method of installing the wellhead connection onto a casing in which the slip energizing step is separated from the metal sealing step such that the integrity of the metal seal is not compromised.

Broadly stated, the invention provides a wellhead connection for connecting and sealing to a casing. The wellhead connection includes:

a) a generally tubular, pressure-containing upper head housing defining a central bore to accommodate the upper end of the casing, a stop shoulder formed in the central bore to allow the upper head housing to rest on the upper end of the casing, and a seal profile section formed at the lower end of the central bore below the stop shoulder;

b) an annular slip housing below the upper head housing, the slip housing providing slip connectors to be positioned around the casing for gripping the outer wall of the casing;

c) an annular bottom ring between the upper head housing and the slip housing, the bottom ring providing a top connector configured to connect to the upper head housing and a bottom connector configured to connect to the slip housing, the bottom ring providing an extension of the central bore to accommodate the casing; and d) a metal seal ring located around the casing in the seal profile section of the upper head housing and being configured so as to be compressed radially inwardly by the seal profile section of the upper head housing to form a metal seal to both the casing and the upper head housing.

The above wellhead connection is configured for sequential energization steps such that, firstly connecting the slip housing and the bottom ring with the bottom connector energizes the slip connectors into gripping engagement with the casing and locks the slip housing and bottom ring around the casing. Secondly, connecting the upper head housing and the bottom ring with the top connector energizes the metal seal ring so as to radially compress the metal seal ring against the casing to form the metal seal.

The invention also broadly provides a method for making a wellhead connection to connect and seal to a casing. The method includes the following steps:

providing a generally tubular, pressure-containing upper head housing defining a central bore to accommodate an upper end of the casing, the central bore forming a seal profile section at its lower end;

providing an annular slip housing to be located below the upper head housing, the slip housing providing slip connectors to be positioned around the casing for gripping on the casing;

providing an annular bottom ring between the upper head housing and the slip housing, the bottom ring being configured to surround the casing and to provide for connection to both the upper head housing and to the slip housing;

assembling the upper head housing, bottom ring and slip housing to form an assembled casing head and resting the assembled casing head on the casing;

connecting the slip housing and the bottom ring together to energize the slip connectors into gripping engagement with the casing and to lock the slip housing and bottom ring around the casing;

removing the upper head housing from the bottom ring and providing a metal seal ring around the casing above the bottom ring;

replacing the upper head housing to rest on the casing such that the metal seal ring is supported within the seal profile section of the upper head housing; and connecting the upper head housing and the bottom ring to energize the metal seal ring so as to radially compress the metal seal ring against the casing to form the metal seal.

In the preferred embodiment of the figures, the wellhead connection is shown as a casing head connected to a surface casing (for example), but the invention has broad application to other wellhead connections in which slip lock connectors (slip connectors) may be used to connect to a tubular pipe. Thus the terms "casing" or "surface casing" as used herein and in the claims are meant to include any tubular pipe. The term "casing head" is used in the preferred embodiment as exemplary of any wellhead connection, such as a tubing head or the like, and as used herein and in the claims, "casing head" it is meant to include these alternatives.

In the preferred embodiments, the casing head of this invention provides a metal seal pressure barrier between the casing head and the surface casing to eliminate the need to weld on the casing head to the casing. The invention is particularly designed for preferred usage where elastomer seals alone cannot be used due to elevated operating temperature or when welding the casing to the casing head is not feasible (ex. critical sour wells where welding may compromise the casing resistance to $H_2S$).

DETAILED DESCRIPTION

As used herein and in the claims, the word "comprising" is used in its non-limiting sense to mean that items following the word in the sentence are included and that items not specifically mentioned are not excluded. The use of the indefinite article "a" in the claims before an element means that one of the elements is specified, but does not specifically exclude others of the elements being present, unless the context clearly requires that there be one and only one of the elements. For example, the term "a metal seal ring" as used herein and in the claims may include multiple metal seal rings such as a pair.

Figure 1:
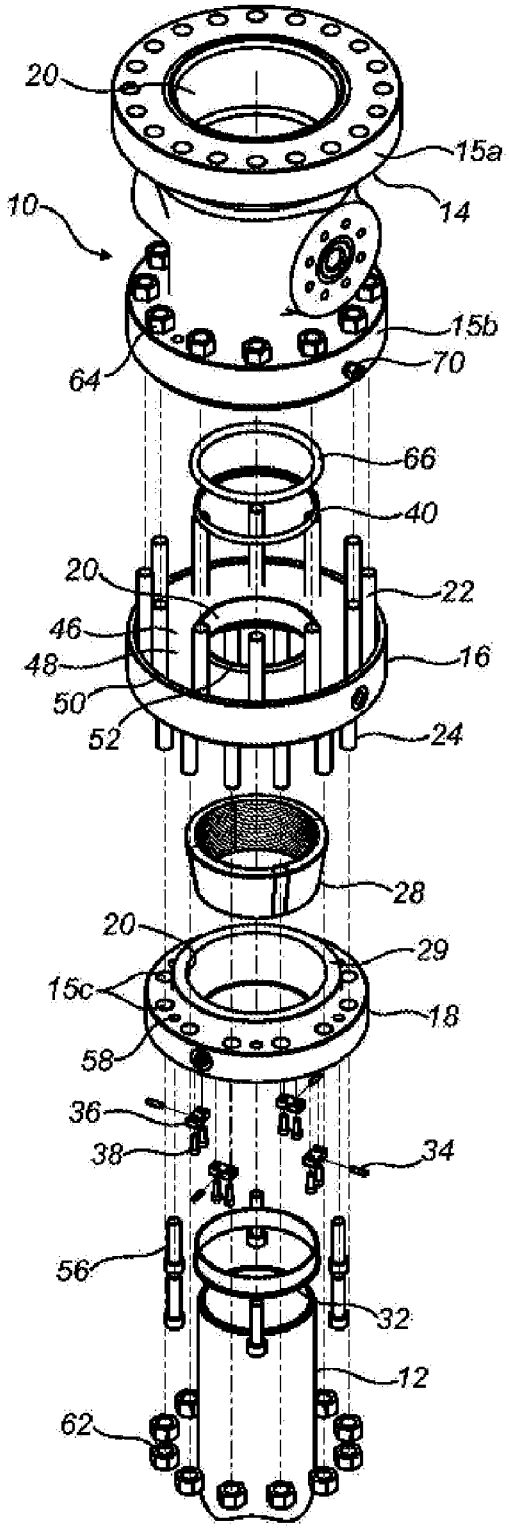
FIG. 1 is an exploded top perspective view of the components of a casing head of the present invention, showing the components in vertical alignment for installation on a surface casing.

Having reference to FIG. 1, the casing head of this invention is shown generally at 10 with the components vertically aligned for placement on the surface casing 12. The casing head 10 is shown to include three main generally tubular housing components, in top to bottom stacking order including an upper head housing 14, an annular bottom ring 16, and an annular slip housing 18. The assembled casing head 10 contains these three interconnected housing components 14, 16, 18 and other components as described below. An aligned central bore 20 is formed through these housing components to accommodate to the surface casing 12 in close fitting relationship. The central bore 20 is shown in the figures to be a vertical bore centrally located in the housing components 14, 16, 18. However, the central bore may be offset, or inclined at an angle off vertical as is known in wellhead designs such as are used, for example in inclined or horizontal wells. Thus, the term "central bore" as used herein and in the claims is meant to include these variations. The upper head housing 14, bottom ring 16 and slip housing 18 are connected together so as to form the pressure-containing casing head 10 on the surface casing 12. The upper head housing 14 is formed with a top connection such a flange connection 15*a*, for connecting to wellhead members located thereabove. A bottom connection such as a bottom flange 15*b* provides for connection to the bottom ring 16. As shown in embodiments provided herein, the bottom ring 16 may be provided with top and bottom bolt connectors 22, 24 for connecting through circumferentially spaced bolt ports 15*c* formed in each of the bottom flange 15*b* of the upper head housing 14 and the slip housing 18.

Figure 2:
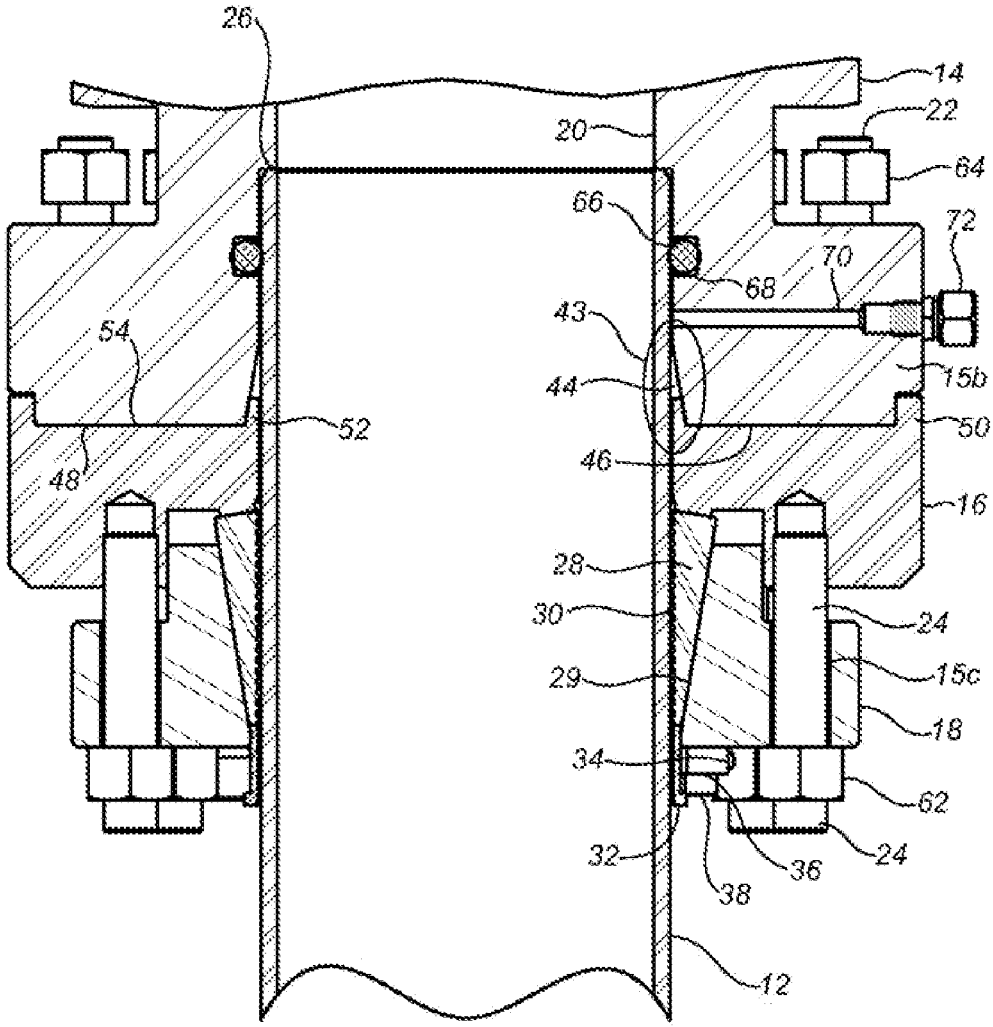
FIG. 2 is a side sectional view of a casing head showing the upper head housing shouldered on the casing in order to align the slips for energizing, prior to installing the metal seal.
Figure 4:
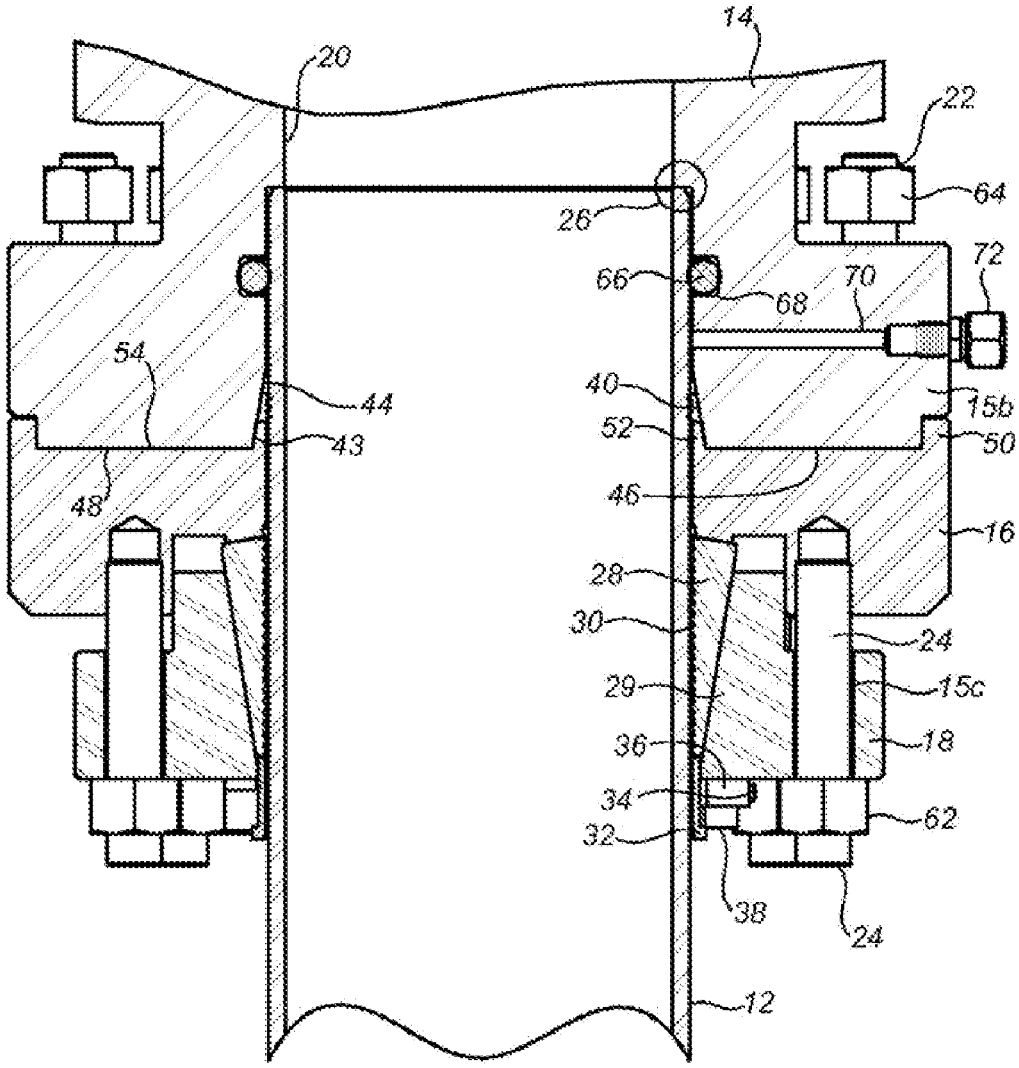
FIG. 4 is a side sectional view of a casing head with the upper head housing bolted in place above the slip housing so as to energize the metal seal against the casing.

As best shown in the sectional views of FIGS. 2 and 4, the upper head housing 14 is formed with a step in the central bore 20 so as to provide a casing stop shoulder 26 to allow the upper head housing 14 to rest on the surface casing 12 and support any weight load put on the upper head housing 14. As more fully described below, the central bore 20 of the upper head housing 14 is widened at its lower end (compared to the outside diameter of the casing 12) below the stop shoulder 26 to form a seal profile section 43 to accommodate a metal seal ring 40. The seal profile section 43 (shown circled in FIG. 2) is preferably a tapered section 44 which tapers inwardly in the direction of the central bore 20 (i.e., forms a conical surface at the central bore, narrowing in the upward direction). The seal profile section 43 serves to accommodate and radially compress a metal seal ring 40. Additional components and installation are described below, with reference to the figures.

Slip housing 18 houses conical segmented casing slips 28 and is used to translate a bolting force from the bottom bolt connectors 24 into a radial force to engage the casing slips 28 against the outer surface of the casing 12. The central bore 20 of the slip housing 18 forms a slip bowl 29 which is reverse conical shaped at its inside diameter to mate with the conical casing slips 28 in order to move the slips 28 radially inwardly against the casing 12. Teeth 30 are formed on the inner diameter of the slips 28 and are upwardly directed to engage and grip onto the surface casing 12, making the retaining connection between the casing head 10 and the casing 12. Alternatively, the teeth 30 might be modified to form grooves or other retaining means (as known in the art) for the slips 28 to engage, grip, retain and support the casing head 10.

A slip support sleeve 32 connected at the lower end of the slip housing 18 is used to maintain proper positioning of the casing slips 28 within the slip housing 18 prior to and during installation. The sleeve 32 holds the slips 28 in their uppermost position in the slip housing 18. The slip support sleeve 32 fits against the casing 12 and is retained by slip support sleeve cap screws 34 which are threaded through slip support sleeve brackets 36, which in turn are connected by bracket screws 38 to the bottom of the slip housing 18. The slip support sleeve cap screws 34 are used to lock the sleeve 32 in place before installation.

Figure 3:
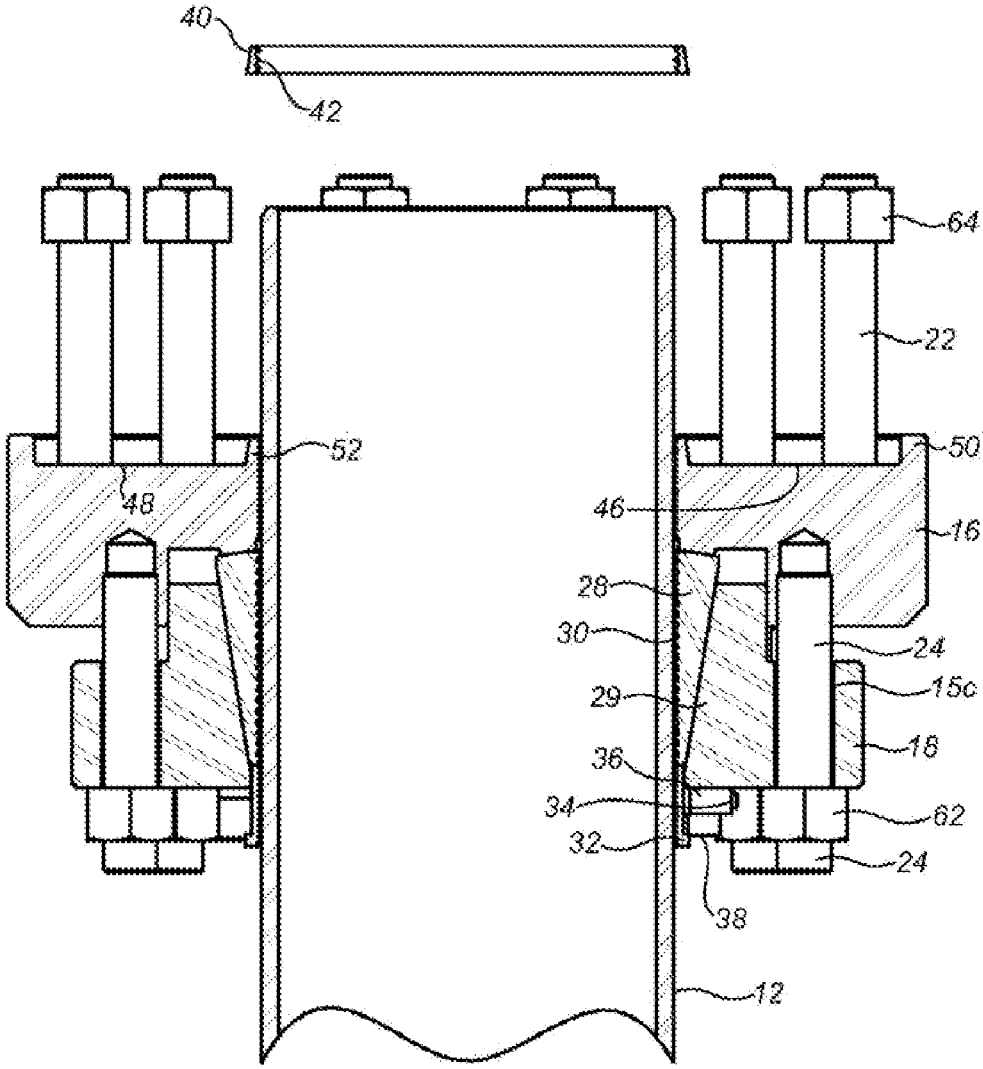
FIG. 3 is a side sectional view of a lower slip housing and bottom ring with the energized slips in place on the casing, but showing the upper head housing removed for installation of the metal seal ring.

The metal seal ring 40 is a collapsible metal ring which provides the metal seal to the casing 12 within the seal profile section 43 of the central bore 20 of the upper head housing 14. The metal seal ring 40 is formed with teeth 42 on its inner diameter. The outer diameter of the ring 40 is preferably tapered inwardly so as to apply radial force from the upper head housing 14, and force teeth 42 on the inner diameter to bite into the surface casing 12. The ring 40 forms a seal against the casing 12 on one side and to the central bore 20 of the upper head housing 14 on the other, creating a continuous metal seal. As shown in FIG. 3, the metal seal ring 40 is formed with an inside diameter sized to fit closely around the surface casing 12. As shown in the embodiment of FIG. 3, the teeth 42 are preferably inwardly projecting to bite into the casing 12 at about 90°. The metal seal ring 40 is made from a metal which permits compression, for example 316 stainless steel in the annealed condition.

The bottom ring 16 is generally shaped as an annular plate and includes upwardly and downwardly projecting bolt connectors 22, 24 to provide top and bottom connectors to the upper head housing 14 and the slip housing 18 respectively. The top bolt connectors 22 are used to connect the upper head housing 14 and to radially compress and crush the metal seal ring 40 with this action. The bottom bolt connectors 24 are used to attach to the slip housing 18 and to energize the casing slips 28 against the casing 12 in that action. The bottom ring 16 supports the metal seal ring 40 prior to its radial compression. Preferably, the top face 46 of the bottom ring 16 is formed with a recessed face 48, and raised circumferential outer and inner rims 50, 52, with the inner rim 52 being at the central bore 20. The inner rim 52 functions to support the metal seal ring 40, and to energize the metal seal ring 40 in conjunction with the upper head housing 14. The upper head housing 14 has a lower face 54 which mates flush with the recessed face 48 of the bottom ring 16. The large mated surface areas between the bottom ring 16 and the upper head housing 14 add rigidity to the assembled casing head 10 to resist bending loads.

Figure 5:
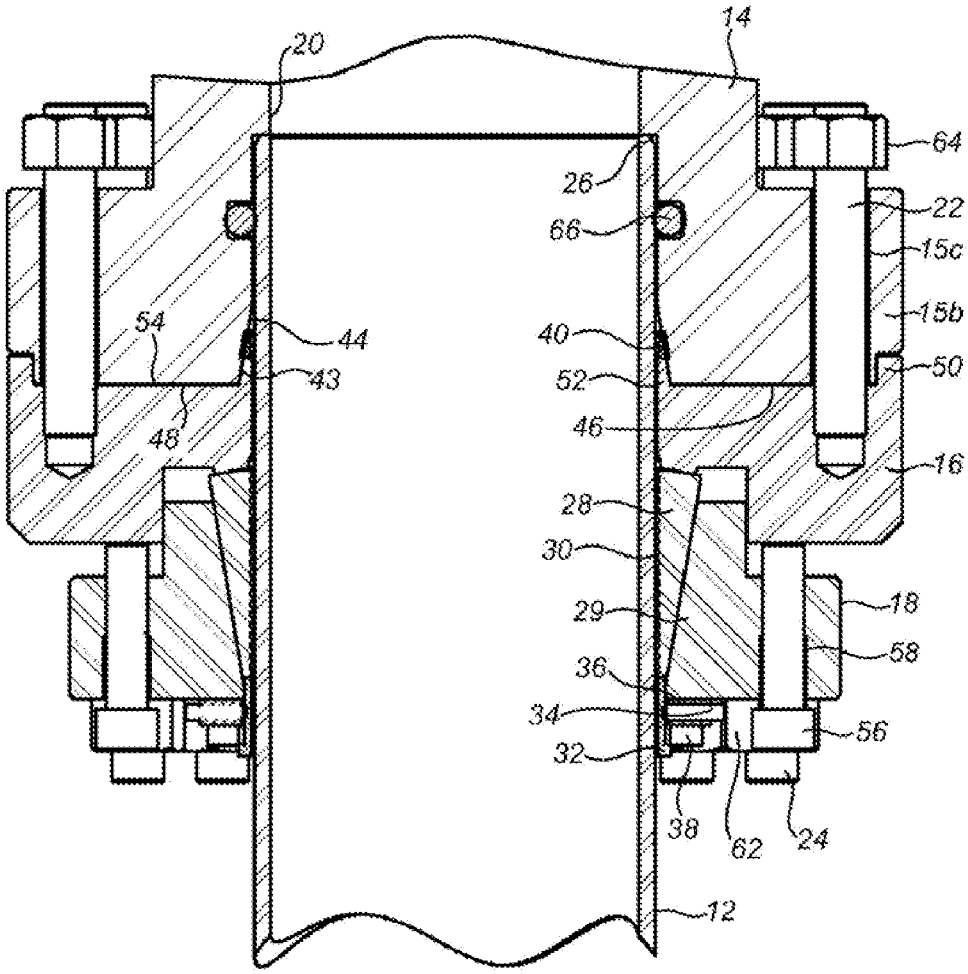
FIG. 5 is a side section view of a fully assembled casing head as in FIG. 4, but rotated to show the slip standoff members pushing upwardly against the bottom of the bottom ring.

The tapered section 44 on the central bore 20 of the upper head housing 14 is formed such that the seal profile section 43 has a taper profile (conical surface) which, at its lower part, accommodates the outside diameter of the metal seal ring 40. The upper part of the taper profile narrows inwardly such that it is smaller than the outside diameter of the metal seal ring 40, in order to radially compress the metal seal ring 40 against the casing 12 within the seal profile section 43 when the upper head housing 14 is bolted down on the bottom ring 16. A number of design features prevent vertical movement of the metal ring seal 40 relative to the casing 12 during this seal energizing step. By separating and first conducting the slip energizing step, with the separate lower slip housing 18 and bottom ring 16 design, the metal seal to the casing 12 is thereafter created on a stationary, solid platform that is formed once the slip housing 18 and the bottom ring 16 are fixed to the casing 12. Thus, as more fully described below, the slip energizing step as shown in FIG. 2 takes place without the metal seal ring 40 being present. This is followed by the metal seal energizing steps shown in FIGS. 3, 4 and 5. The metal seal ring 40 rests on the inner rim 52 of the fixed bottom ring 16, so is prevented from moving vertically downwardly. The teeth 42 of the metal seal ring 40 bite into the casing 12, also resisting vertical movement. As the tapered section 44 of the upper head housing 14 slides downwardly over the matching taper of the metal seal ring 40, the seal ring 40 is compressed only radially inwardly in the narrower upper part of the seal profile section 43 (the upper part of the seal profile section is narrower than the taper on the metal seal ring 40).

A plurality of locking cap screws 56 (six shown in FIG. 1) allow for a predefined standoff between the slip housing 18 and the bottom ring 16, making sure that the slip segments 28 are loose and properly positioned during installation. The locking cap screws 56 are installed through threaded holes 58 in the slip housing 18 to be able to push the bottom of the bottom ring 16 (best shown in FIG. 5). After the casing head 10 is fully installed, the cap screws 56 are tightened once again to reduce bending stresses on the metal seal ring 40.

A plurality of slip engaging nuts 62 are used to engage the slips 28. The nuts 62 are tightened on the bottom bolt connectors 24 of the bottom ring 16 until the slips 28 are sufficiently engaged against the casing 12.

A plurality of metal seal engaging nuts 64 are used to engage the metal seal ring 40 by tightening on the top bolt connectors 22 of the bottom ring 16. The nuts 64 are tightened (engaged) until the upper head housing 14 and the bottom ring 16 are fully mated.

Preferably, an O-ring seal 66 is provided in a recess 68 formed at the central bore 20 of the upper head housing 14, above the tapered section 44. The O-ring 66 is provided as a secondary sacrificial seal. The O-ring 66 is also used to test the metal seal through seal test port 70, located through the side wall of the upper head housing 14 to the central bore 20, between the O-ring 66 and the tapered section 44. The test port 70 is sealed and closed by pressure fittings 72. Once the metal seal is confirmed, the O-ring may succumb to high temperature or high $H_2S$ environment.

Assembly/Installation

The components of the casing head 10 are assembled, excluding the metal seal ring 40, as shown in FIG. 2. The locking cap screws 56 are adjusted first, followed by the slip engaging nuts 62. Next, the slip support sleeve 32 is raised until the slips 28 are in their uppermost position. The metal seal engaging nuts 64 are tightened until mating surfaces of the upper head housing 14 and bottom ring 16 are flush. The assembled casing head 10 is then lowered over the surface casing 12 until seated on the casing head stop shoulder 26.

The locking cap screws 56 are retracted. The slip engaging nuts 62 are then tightened to engage the casing slips 28. Once the casing slips 28 are engaged, the locking cap screws 56 are tightened once more. The upper head housing 14 is then removed by removing the metal seal engagement nuts 64.

The metal seal ring 40 is slipped onto the casing 12, with the inwardly tapered section 44 facing upwardly, and the upper head housing 14 is once again placed on top of the bottom ring 16.

The metal seal engaging nuts 64 are tightened until the upper head housing 14 and the bottom ring 16 mating surfaces 54, 48 are flush and the casing 12 is flush with the casing stop shoulder 26. In so doing, the metal seal ring 40 is collapsed radially inwardly and bites into the surface casing 12, creating a metal seal to both the casing 12 on one side and to the upper head housing 14 on the other side.

The seals can be pressure tested between the O-ring 66 and the metal seal ring 40 by the seal ring test port 70.

ADVANTAGES OF PREFERRED EMBODIMENTS OF THE PRESENT INVENTION

The casing slips 28 are first locked onto the casing 12, which then provides a rigid base to use in energizing the metal seal.

The separate slip and metal seal energizing arrangement (with slips being energized first) ensures that the metal seal is engaged in such a way that it only moves radially inwardly, preventing vertical movement of the seal ring 40 against the casing 12 to prevent damaging the metal seal.

The slip and metal seal energizing actions are both in the same direction (unlike U.S. Pat. No. 5,158,326 to Anderson), with the casing 12 pulling down in the normal manner, limiting upward casing movement which could damage the metal seal.

The embodiments depicted in FIGS. 1-5 can be made up completely and easily with conventional wrenches.

No machining of the casing is required for the slip lock connection to work.

ALTERNATIVE EMBODIMENTS

The following are non-limiting options or alternatives to the embodiments described above, all of which are understood to be included within the scope of the claims which follow.

The design of the preferred embodiment shows a bolted connection between the housing components 14, 16, 18, but other means could be used to attach the parts such as a clamped hub connection or a radial engaged lockscrew arrangement, as known in the art.

Alternate slip energizing and/or metal seal energizing means might be used, for instance, the slips and seal may be energized with hydraulic pressure (similar to U.S. Pat. No. 5,158,326 to Anderson).

The embodiments depicted in the figures lock the casing 12 into the casing head 10 by jamming the casing 12 from vertical movement between the casing stop shoulder 26 and the slips 28. Optionally, an adjustable casing stop shoulder may be provided (ex. threaded in through the top of the casing head). A further option would eliminate the stop shoulder by using a double taper slip design similar to U.S. Pat. No. 5,135,266 to Bridges et al. In that option, the top slips could be used to prevent upward movement of the casing, replacing the function of casing stop shoulder.

The embodiments depicted in the figures could be modified to work with a landing base. For example a landing base similar to the one shown in U.S. Pat. No. 6,834,718 to Webster et al. might be used.

The embodiments depicted in the figures include a seal test port 70 between the metal seal and an O-ring 66 so the integrity of the metal seal can be verified after installation. Optionally a casing cup tool can be inserted into the casing below the metal seal to pressure test the seal. If this method of pressure testing is used the O-ring and test port can be eliminated from the design.

The slip support provided by the slip support sleeve 32 might be altered to use alternate retaining rings or shearing pins, as known in the prior art.

The raised inner circumferential rim 52 of the bottom ring 16 used to support the metal seal ring 40 might be provided by a separate member such as a bushing, or the metal seal ring might be configured to incorporate a support section which in turn is supported by the bottom ring 16.

Alternate slip standoff members from the locking cap screws might be used, for example shear pins.

Multiple metal seal rings, such as reverse tapered metal seal rings similar to those of U.S. Pat. No. 5,158,326, might be used with a stop shoulder or recess of the casing head.

All references mentioned in this specification are indicative of the level of skill in the art of this invention. All references are herein incorporated by reference in their entirety to the same extent as if each reference was specifically and individually indicated to be incorporated by reference. However, if any inconsistency arises between a cited reference and the present disclosure, the present disclosure takes precedence. Some references provided herein are incorporated by reference herein to provide details concerning the state of the art prior to the filing of this application, other references may be cited to provide additional or alternative device elements, additional or alternative materials, additional or alternative methods of analysis or application of the invention.

The terms and expressions used are, unless otherwise defined herein, used as terms of description and not limitation. There is no intention, in using such terms and expressions, of excluding equivalents of the features illustrated and described, it being recognized that the scope of the invention is defined and limited only by the claims which follow. Although the description herein contains many specifics, these should not be construed as limiting the scope of the invention, but as merely providing illustrations of some of the embodiments of the invention.

One of ordinary skill in the art will appreciate that elements and materials other than those specifically exemplified can be employed in the practice of the invention without resort to undue experimentation. All art-known functional equivalents, of any such elements and materials are intended to be included in this invention within the scope of the claims, including without limitation the options and alternatives mentioned herein. The invention illustratively described herein suitably may be practiced in the absence of any element or elements, limitation or limitations which is not specifically disclosed herein.

We claim:

1. A wellhead connection for connecting and sealing a wellhead onto a casing, the casing having an outer wall and an upper end, the wellhead connection comprising:

a generally tubular, pressure-containing upper head housing defining a central bore to accommodate the upper end of the casing, a stop shoulder formed in the central bore, the stop shoulder being configured to allow the upper head housing to rest on the upper end of the casing to support a weight load put on the upper head housing by the wellhead, and the upper head housing forming a seal profile section at the lower end of the central bore below the stop shoulder;

a metal seal ring located around the casing in the seal profile section of the upper head housing and being configured so as to be compressed radially inwardly by the seal profile section of the upper head housing to form a metal seal to both the casing and the upper head housing, the metal seal ring being conically tapered on its outside diameter, and being formed with inwardly projecting teeth which bite into the casing as the metal seal ring is radially compressed;

the seal profile section of the upper head housing being tapered to provide a conical surface having a taper profile, which at an upper part narrows inwardly so as to be diametrically smaller than the outside diameter of the metal seal ring such that the metal seal ring is radially compressed in the narrower part of the seal profile section;

an annular slip housing below the upper head housing, the slip housing providing a slip connector to be positioned around the casing for gripping the outer wall of the casing, the slip connector comprising a plurality of segmented conical shaped slips, each slip having a conical external surface, and an internal circumferential surface formed with grooves or teeth configured to engage, grip and support the casing, the slip housing forming a slip bowl shaped to mate with the conical shaped slips during slip energizing, and the slip housing carrying a slip support member to prevent downward movement of the slips prior to slip energizing;

an annular bottom ring between the upper head housing and the slip housing, the bottom ring providing a top connector configured to connect to the upper head housing and a bottom connector configured to connect to the slip housing, the bottom ring providing an extension to the central bore to accommodate the casing, and the bottom ring being configured to support the metal seal ring within the seal profile section against downward vertical movement as the metal seal is being radially compressed, and the bottom ring providing a raised inner circumferential rim adjacent the casing below the metal seal ring to support the metal seal ring within the seal profile section against downward vertical movement during metal seal ring energizing; and a plurality of threaded cap screws between the slip housing and the bottom ring to push upwardly on the bottom ring after slip energizing;

such that, connecting the slip housing and the bottom ring with the bottom connector energizes the slips upon upward movement of the slip housing into gripping engagement with the casing and locks the slip housing and the bottom ring around the casing, and thereafter connecting the upper head housing and the bottom ring with the top connector energizes the metal seal ring by radially compressing the metal seal ring against the casing to form the metal seal and brings the stop shoulder to rest on the upper end of the casing.

2. The wellhead connection of claim 1, wherein the top and bottom connectors include top and bottom bolted connections to the upper head housing and the slip housing respectively.

3. The wellhead connection of claim 1, wherein the slip support member comprises a slip support sleeve located below the slips in contact with the slips to prevent downward displacement of the slips, and wherein the slip support sleeve is locked in place before installation by slip support sleeve screws located at the bottom of the slip housing.

4. The wellhead connection of claim 3, wherein a bottom face of the upper head housing and an upper face of the bottom ring form flush mating surfaces, and wherein the upper head housing bottom face accommodates both the raised inner circumferential rim of the bottom ring and a raised outer circumferential rim formed on the bottom ring.

5. The wellhead connection of claim 4, wherein the upper head housing carries a secondary seal to the casing above the metal seal ring, and wherein the upper head housing further comprises a sealed seal test port formed through a side wall of the upper head housing to the central bore at a location between the secondary seal and the metal seal ring.

6. The wellhead connection of claim 5, wherein the secondary seal is an O-ring seal held in a recess formed at the central bore of the upper head housing.

7. A method for making a wellhead connection to connect and seal a wellhead onto a casing, the method comprising the steps of:

providing a generally tubular, pressure-containing upper head housing defining a central bore to accommodate an upper end of the casing such that the upper head housing rests on the upper end of the casing to support a weight load put on the upper head housing by the wellhead, the upper head housing forming a seal profile section at the lower end of the central bore below the stop shoulder;

providing a metal seal ring which is conically tapered on its outside diameter so as to be compressed radially inwardly by the seal profile section of the upper head housing during metal seal ring energization, and being formed with inwardly projecting teeth which bite into the casing as the metal seal ring is radially compressed;

providing the seal profile section of the upper head housing with a conical surface having a taper profile, which at an upper part narrows inwardly so as to be diametrically smaller than the outside diameter of the metal seal ring such that the metal seal ring is radially compressed in the narrower part of the seal profile section;

providing an annular slip housing to be located below the upper head housing, the slip housing providing a slip connector to be positioned around the casing for gripping on the casing, the slip connector comprising a plurality of segmented conical shaped slips, each slip having a conical external surface, and an internal circumferential surface formed with grooves or teeth configured to engage, grip and support the casing, the slip housing forming a slip bowl shaped to mate with the conical shaped slips during slip energizing, and the slip housing carrying a slip support member to prevent downward movement of the slips prior to slip energizing;

providing an annular bottom ring between the upper head housing and the slip housing, the bottom ring being configured to surround the casing, to provide a top connector configured to connect to the upper head housing and a bottom connector configured to connect to the slip housing, and to support a metal seal ring within the seal profile section against downward vertical movement, the bottom ring providing a raised inner circumferential rim adjacent the casing below the metal seal ring to support the metal seal ring during metal seal ring energizing;

providing a plurality of threaded cap screws between the slip housing and the bottom ring to push upwardly on the bottom ring after slip energizing;

assembling the upper head housing, the bottom ring and the slip housing around the casing with the stop shoulder resting on the upper end of the casing and without the metal seal ring being present;

connecting the slip housing and the bottom ring together with the bottom connector to energize the slips upon upward movement of the slip housing into gripping engagement with the casing and to lock the slip housing and the bottom ring around the casing against vertical movement;

removing the upper head housing from the bottom ring and installing the metal seal ring around the casing above the bottom ring;

replacing the upper head housing such that the metal seal ring is supported by the bottom ring within the seal profile section of the upper head housing; and thereafter connecting the upper head housing and the bottom ring with the top connector to both energize the metal seal ring by radially compressing the metal seal ring against the casing to form the metal seal, and to bring the stop shoulder to rest on the upper end of the casing.

8. The method of claim 7, wherein the upper head housing, bottom ring and slip housing are assembled to form an assembled casing head prior to resting the assembled casing head on the upper end of the casing.

9. The method of claim 7, wherein:

a bottom face of the upper head housing and an upper face of the bottom ring form flush mating surfaces, the upper head housing bottom face accommodates both the raised inner circumferential rim of the bottom ring and a raised outer circumferential rim formed on the bottom ring;

the slip support member comprises a slip support sleeve located below the slips in contact with the slips to prevent downward displacement of the slips, and the slip support sleeve is locked in place before installation by slip support sleeve screws located at the bottom of the slip housing.

10. The method of claim 9, wherein the upper head housing carries a secondary seal to the casing above the metal seal ring, and wherein the upper head housing further comprises a sealed seal test port formed through a side wall of the upper head housing to the central bore at a location between the secondary seal and the metal seal ring.

* * * * *